US005927375A

United States Patent [19]

Damasse et al.

[11] Patent Number: 5,927,375

[45] Date of Patent: Jul. 27, 1999

[54] CONTINUOUS CASTING PROCESS BETWEEN ROLLS

[75] Inventors: Jean-Michel Damasse, Metz; Olivier Salvado, Thorigny, both of France

[73] Assignees: Usinor of Puteaux, France; Thyssen Stahl Aktiengesellschaft of Duisburg, Germany

[21] Appl. No.: 08/966,115

[22] Filed: Nov. 7, 1997

[30] Foreign Application Priority Data

Nov. 7, 1996 [FR] France ..... 96 13777

[51] Int. Cl.[6] ..... B22D 11/06; B22D 11/16

[52] U.S. Cl. ..... 164/451; 164/452; 164/480

[58] Field of Search ..... 164/452, 451, 164/480, 154.1, 154.4, 154.5, 428, 154.8

[56] References Cited

U.S. PATENT DOCUMENTS

| | | | |
|---|---|---|---|
| 4,222,254 | 9/1980 | King, Jr. et al. . | |
| 4,678,023 | 7/1987 | Knapp et al. | 164/452 |
| 4,702,300 | 10/1987 | Nakanori et al. | 164/154.8 X |
| 4,850,211 | 7/1989 | Sekiguchi et al. . | |
| 4,910,985 | 3/1990 | Ballyns . | |
| 5,203,188 | 4/1993 | Osgood et al. . | |

FOREIGN PATENT DOCUMENTS

| | | | |
|---|---|---|---|
| 0 719 607 | 7/1996 | European Pat. Off. . | |
| 60-83747 | 5/1985 | Japan | 164/428 |
| 61-200453 | 9/1986 | Japan . | |
| 61-232044 | 10/1986 | Japan | 164/452 |
| 62-6740 | 1/1987 | Japan | 164/480 |
| 2-80160 | 3/1990 | Japan | 164/480 |
| 4-100666 | 4/1992 | Japan . | |
| 4-351250 | 12/1992 | Japan | 164/425 |
| 5-115946 | 5/1993 | Japan | 164/452 |

*Primary Examiner*—J. Reed Batten, Jr.
*Attorney, Agent, or Firm*—Nilles & Nilles SC

[57] ABSTRACT

Process for detecting defects during continuous casting between rolls where, during casting, a signal depending on the rolls separating force (RSF) is measured, the signal being separated into various harmonic components, the result of the comparison of the harmonic components thus obtained with reference harmonics being representative of a defective status of the rolls, this defective status of the rolls enabling various rules to be defined for the execution of the process.

22 Claims, 3 Drawing Sheets

| Decision Table | | | | | | | |
|---|---|---|---|---|---|---|---|
| A | small | medium | | | large | | |
| | | E \ R | small | large | E \ R | small | large |
| | 1 | small | 1 | 2 | small | 1 | 2 |
| | | large | 2 | 3 | large | 3 | 3 |

1: low disturbances
2: process alarm
3: casting shutdown

CONTINUOUS CASTING PROCESS BETWEEN ROLLS

BACKGROUND OF THE INVENTION

1. Field of the Invention

This invention concerns the continuous casting between two rolls of thin metallic products, especially made of steel.

According to this known technique, the manufactured product, for example a thin strip of steel several millimetres thick, is obtained by pouring molten metal into a casting space defined between two rolls with parallel axes, cooled and rotated in opposite directions. The metal, when it comes into contact with the cold walls of the rolls, called sleeves, solidifies and the skins of the solidified metal, rotated by the rolls, join at the neck between the rolls to form the said strip which is extracted downwards.

The use of the casting process between rolls is submitted to various constraints relevant both to the cast product and the use of the casting installation.

In particular, the section of the cast strip must correspond, in shape and dimensions, to the required section, the real section of the strip being directly dependent on the space, called the gap, between the rolls at the neck.

2. Description of the Related Art

For this, a regulation process for continuous casting between rolls, described in patent application FR-A-2728817 is known, where the rolls separating force (RSF) is measured and the relative position of the said rolls modified to suit. This process enables the relative position of the rolls to be modified; they are moved apart if the force is too high or moved together if the force is too low especially in order to avoid breakouts of liquid metal or even rupture of the cast strip, and also prevent damage to the rolls in case of over-solidification of the cast metal.

Also, it is known that an out-of-round of the rolls cannot be totally avoided, on the one hand, for mechanical reasons and, on the other hand, due to the thermal deformations to which the sleeve is subjected when it first comes into contact with the molten metal when casting is started and also later during the rotation of the rolls. A compensation process for this out-of-round, which will be called hereafter "normal out-of-round" (or again "mechanical out-of-round" even though it is partly of thermal origin), is already known; this process consists of automatically acting on the position of the bearings of at least one of the rolls depending on the angular position of these rolls in order to maintain the gap as constant as possible. As it is practically impossible to directly measure the gap, it has already been proposed to use as a parameter representative of the out-of-round, a signal delivered by rolls separating force measurement means, the out-of-round compensation system then being combined with a regulation system such as described in above mentioned document FR-A-2728817.

However, the use of these processes does not enable real-time detection of certain defects liable to disturb the casting process, to lead to its shutdown or to durably damage the rolls.

Defect detection methods, visual or others, are already known enabling the detection of defects related to the casting process, to the thermal/dynamic characteristics of the molten metal, or again those known as "shiny strips". The latter type of defect corresponds to a local reduction in the surface roughness of the rolls which leads to variations in the cooling of the strip which can be detected by temperature measurements made on the cast strip. However, the observation of these defects can only be done after the event, on the already formed strip, and therefore quite sometime after they have appeared. Now, these defects can damage the surface finish of the rolls and this especially when they are perceived at a late stage, in which case the damage may be irreparable.

Certain defects can be detected a priori from direct observation of the signal representing the rolls separating force. However, variations in this signal represent both variations in the force due to the normal out-of-round and variations due to other parameters or events which may occur during casting. Direct observation of the force signal therefore does not allow to determine the part that each of these causes plays in the variations of the signal to be determined.

OBJECTS AND SUMMARY OF THE INVENTION

The purpose of this invention is to solve the above mentioned problems and aims at enabling, by measuring the rolls separating force (RSF), real-time detection of defects, before an amplification of these defects causes irreparable damage, especially to the rolls. The purpose of the invention is also to enable the follow-up of changes to these defects, in order to propose corrective actions or interrupt of the casting to the operator depending on the seriousness of the said defects.

With these targets in mind, the subject of the invention is a continuous casting process between rolls to obtain thin metallic products, especially made of steel, where, during casting, the rolls separating force is continuously measured and a signal representative of the variations in the rolls separating force (RSF) measured in relation to time, and where the setting of the rolls is modified, especially in relation to the said signal, to compensate for the out-of-round of the rolls, this process being characterised in that, in order to detect defects other than rolls out-of-round, the said signal is decomposed into different harmonic components and the said harmonic components are compared with reference harmonics of corresponding order, the results of the said comparison being representative of the status of the casting process defect, and, according to the results of the said comparison, casting process control rules are defined.

In effect, the inventors have been able to establish, following many tests conducted on an industrial scale, that a certain relation exists between the variations in the signals representative of the separating force and the appearance of defects during casting. For example, the appearance of a defect called shiny strip on a roll is characterised by the presence of a disturbance in the measured separating force signal. This disturbance is cyclic and occurs for each revolution of the roll. This disturbance reflects over-solidification of the product when it passes the neck and leads to variations in the force which are clearly more rapid than those which would be generated for instance by variations in the thickness of the solidified product.

The inventors then imagined the decompositon of the said signals into harmonics in order to differentiate in these signals the part which could be allocated to the normal out-of-round from the part due to other causes. The inventors thus checked, by comparing the harmonic components recorded during various castings, that, although the signals representative of the separating force vary in particular according to the out-of-round, and even when this out-of-round is compensated for by the compensation system, variations in certain harmonic components corresponded to the appearance of defects during castings. It therefore came to light that an analysis of these harmonic components, performed continuously during castings, would allow, by comparison with a reference obtained experimentally during castings considered to be without defects, to detect in almost real time deviations revealing such casting defects much more rapidly than with the known methods.

A hypothesis explaining the relation which exists between the variations in the harmonic components and the presence of casting defects is that the normal out-of-round causes variations in the signal representative of the rolls separating force (RSF) which are mainly slow and gentle. In other words the signal has, on account of the said normal out-of-round, mainly a low-order harmonic component, with a frequency equal to the roll rotational frequency. However, real defects, such as the above mentioned shiny strips, mainly lead to sudden variations in the said signal and therefore to harmonics of a higher order. Typically, the spectrum of the signal representative of the rolls separating force and resulting only from the normal out-of-round is characterised by a high harmonic component of order 0 (for example 70% of the total amplitude of the signal) and rapidly decreasing harmonics for the higher orders (20% for the order 1 harmonic, 10% for the order 2 harmonic). Rarely, the presence of harmonics of a higher order is observed. However, when shiny strips are present, the distribution of the harmonics is different from the case above, the presence of an over-solidified edge at the level of the shiny strip generates more higher harmonics.

It is specified that hereafter, the component of the signal with a frequency $F_i=2^iF_0$ will be designated the harmonic of order i, $F_0$ being the fundamental frequency corresponding to roll rotational speed. Likewise, hereafter the amplitude of the harmonic components of order i will be designated $h_i$ and a value representative of the harmonics of order i taken over a predetermined number of roll revolutions will be designated $H_i$.

According to a specific arrangement of the invention where a gap regulation system, such as the one described above, is installed, an associated signal used as the bearing displacement reference of at least one roller can be used as a signal representative of the variations in the rolls separating force (RSF), obtained by measuring the said force. In other words, the signal which is then decomposed into various harmonic components is directly related to the said displacement reference which is generated by an out-of-round compensation module, and therefore reflects the separating force variations.

To decompose the signal into its various harmonic components, a fast Fourier transform could especially be used, applied to the signal representative of the rolls separating force (RSF), this signal therefore being either directly the separating force measurement signal, or a corresponding signal generated by the said out-of-round compensation module.

In a preferred arrangement of the invention, the value $H_i$ representative of each harmonic of order i is calculated as being a mean value of the amplitudes $h_i$ of each harmonic, determined over a given number of roller revolutions. As the value $H_i$, representative of each harmonic, is calculated as being a mean value of the measured amplitudes over a given number of revolutions, this allows the effect of random defects, which are located in time and in space and non-repetitive over several roll revolutions, to be attenuated. Thus, if a defect is generated by a durable problem on a roll, the system will completely integrate this data after the said number of revolutions whereas the effect of the harmonics, appearing on only a low number of revolutions, especially lower than the said number of given revolutions, will be considerably attenuated.

The comparison of the measured signal with a signal from a casting judged as good can be made in various ways. The values $H_i$ representative of each harmonic of the measured signal can be simply compared, term by term, to reference values $H_{ir}$ obtained from measurements made on castings judged as good, and it can be checked that the sum of the differences of values $H_i$ representative of each harmonic with the reference values $H_{ir}$ is not too high. Alternatively, the proportion of each harmonic can be compared with a proportional reference distribution. However, preferably, the comparison will be made on the basis of a harmonic barycentre, this barycentre being calculated by weighting each harmonic with a predetermined coefficient in order to give relative importances to the various harmonics by unequally weighting the latter. This calculation method is justified by experimental observations: during a casting judged as good, the first harmonic is the most important, the importance of the various harmonics decreasing as a function of the increasing order of the harmonics considered. By weighting the harmonics of the highest order with a suitable coefficient, the variations of these high order harmonics will be as it were amplified, making their appearance or augmentation more easily perceptible in the result of the barycentre calculation.

For example, a frequency barycentre $B_f$ can be calculated by allocating a coefficient representing the amplitude of the harmonic considered to each harmonic frequency:

$$B_f(Hz)=\Sigma H_i{*}F_i/\Sigma H_i$$

and this barycentre can be normed by the fundamental frequency to obtain a ratio $R=B_f/F_0$ which could be compared with a predetermined reference value $R_0$ to get rid of any fundamental frequency differences and therefore any effective roll speed differences between the casting considered and the reference.

In addition, the derivative dR/dt could be calculated and the result also compared to a second predetermined threshold thus enabling the change of the ratio R to be followed up over time, a rapid change of R being a sign of a rapid aggravation of a defect.

With the values of the various parameters:

A representing the total amplitude of the variations: $A=\Sigma H_i$,

R representative of the part or the importance of the defects in the signal, and E=dR/dt, a decision table can be drawn up, as it will be seen later, which could be used to propose in real time to the operator, corrective actions on certain casting parameters, with the aim of correcting defects as rapidly as possible after their appearance.

BRIEF DESCRIPTION OF THE DRAWINGS

Other advantages and features will appear on reading the detailed description which will follow of examples of realisation of the invention, given for information purposes and in no way restrictive, to be read in conjunction with the appended drawings among which.

DESCRIPTION OF THE PREFERRED EMBODIMENTS

Figures 1, 2:
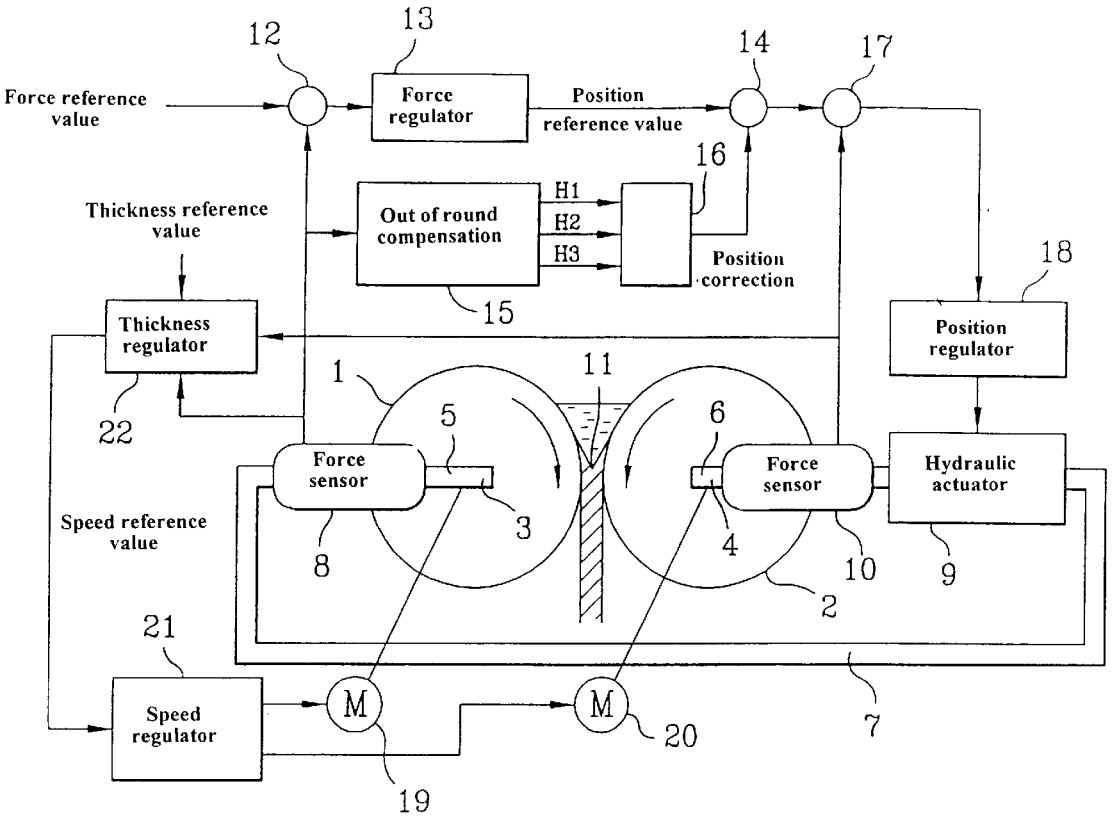
FIG. 1 shows a schematic view of a casting device between rolls with a regulation system of a type known itself, but using harmonic decompostion of the out-of-round compensation signal.
FIG. 2 represents a decision table defining the procedure to be followed during casting as a function of the various values of the parameters delivered by the process according to the invention.

The casting installation, represented only partially on FIG. 1, conventionally includes, as already known, two rolls 1, 2, with parallel axis, spaced apart by a distance called a gap. This corresponds to the required thickness for the cast strip, less the dimentional reduction resulting form deformations due to the RSF. The two rolls 1, 2 are rotated in opposite directions, at same speed. They are carried by the bearings 3, 4, represented schematically, of two supports 5, 6 installed on a frame 7. The support 5, and therefore the axis of corresponding roll 1, is fixed in relation to the frame 7. The other support 6 can move in translation on frame 7. Its position is adjustable and determined by push jacks 9 acting so as to move together or apart the supports 5, 6 one in relation to each other. The rolls separating force (RSF) measuring means, such as balances 8, are positioned between the fixed support 5 and the frame 7. Sensors 10 are used to measure the position of the mobile support 6 and therefore the variations in position in relation to a predetermined reference position according to the required thickness of the strip.

During casting, the molten metal is poured between the rolls and begins to solidify in contact with their cooled walls to form solidified skins which are drived by the rolls and join more or less at the level of the neck 11 between the rolls to form the solidified strip which is extracted downwards. The metal thus exerts a separating force on the rolls (RSF), measured by the balances 8, this force being variable especially according to the degree of solidification of the metal.

To regulate this force, and guarantee the continuity of the casting, the casting installation includes a regulation system. In this regulation system, the difference between the force reference signal and the force signal measured by the force sensor 8 is calculated by a first comparator 12. The signal relevant to this difference is introduced into a force regulator 13 which determines a position reference signal introduced into a second comparator 14. The force signal measured by the force sensor 8 is also introduced into an out-of-round compensation system 15 which decomposes the force signal into harmonics and generates the compensation signals H1, H2, H3 of each of the said harmonics. These signals, H1, H2 and H3, are summed in an adder 16 which generates a position correction reference signal which is transmitted to the second comparator 14. The output signal of the second comparator 14 is introduced into a third comparator 17 together with a position signal from the position sensor 10. The output signal of the third comparator 17 is introduced into the position regulator 18 which controls the jacks 9.

The rotation of the rolls 1 and 2 is ensured respectively by motors 19 and 20 controlled by a speed regulator 21. This speed regulator 21 receives a signal from a thickness regulator 22 receiving itself a thickness reference signal, the force signal transmitted by the force sensor 8 and the position signal transmitted by the position sensor 10.

An action on the jacks 9 is made automatically by this regulation system enabling, for example, to act on jacks 9 in the direction leading to a separation of the rolls to reduce the separating force (RSF) or, conversely, in the direction leading to join the rolls to increase the force. In a similar manner, this system enables compensation, at least partial, of the normal out-of-round, that is to compensate a possible offset existing between the axis of the sleeve and its rotational axis and irregularities in the shape of a roll, whether these irregularities have a mechanical or thermal origin. The regulation system then takes these shape and coaxiality defects into account to give a displacement reference for the push jacks 9 controlling the gap between the rolls in order to maintain this gap as constant as possible during the rotation of the rolls.

A preferred method of determining the various parameters A, R and E, which will be used to inform the operator of the presence of defects and the seriousness of these will now be described.

In this method, the signal representative of the rolls separating force will be decomposed, this decomposition being performed in the out-of-round compensation module 15 by means of a Fourier transform. The same operation could be equally well performed not by using a Fourier transform but by using a Laplace transform or any other mathematical or signal processing operation such as, for instance, the use of filters to obtain the same result, that is the decomposition of the signal into various harmonic components.

Values $H_i$ as stated above will then be calculated, that is, by making an average of amplitudes $H_i$ over a predetermined number of rolls revolutions, for instance, the last ten revolutions. Note that the previous method for calculating coefficients $H_i$ is given as an example and is in no way restrictive. The values $H_i$ representative of each harmonic of order i can also be calculated as being the root mean square value of the amplitude $h_i$ of the harmonics for any other calculated value characterising the said harmonics, this calculation being made by an arithmetical mean, a least squares method or any other method.

Whatever the calculation method, the values $H_i$ are representative of the amplitude relevant to each harmonic of order i and of frequency $F_i$.

Criterion $B_f$ will then be calculated as being a frequency barycentre of the various harmonics. That is, the barycentre of the frequencies of the considered harmonics is calculated, each value $F_i$ being assigned a weight consisting of the corresponding value $H_i$, that is:

$$B_f=\Sigma H_i \times F_i/\Sigma H_i.$$

In general, only harmonics of orders 0, 1 and 2 will be used. However, it is obviously possible to take other harmonics into account.

In order to be able to make valid comparisons at various rolls rotational speeds, the ratio $R_f=B_f/F_0$ is calculated, $F_0$ corresponding to the rolls rotational frequency.

In the case given as an example where only the first three harmonics are taken into account, we then obtain the three following criteria:

global amplitude of the variations of the signal:

$$A=H_1+H_2+H_3,$$

normed barycentre:

$$R_f=(F_1\times H_1+F_2\times H_2+F_3\times H_3)/((H_1+H_2+H_3)\times F_0)$$

change of $R_f$ over time:

$$E=dR_f/dt.$$

A comparison of these various criteria calculated during casting with a predetermined threshold allow then to detect if such or such a defect appears in the current casting.

As an example, in a case where the signal representative of the rolls separating force is the signal obtained from the out-of-round compensation module, that is expressed as a displacement value of the mobile roll, and in presence of normal out-of-round alone, the following could be obtained:

$H_0$=700 μm, $H_1$=200 μm, $H_2$=100 μm, where $F_0$=0.2 Hz, $F_1$=0.4 Hz and $F_2$=0.8 Hz, then $B_f$=0.3 Hz and $R_f$=1.5.

If a shiny strip appears, these values will become 350 μm, 350 μm and 300 μm respectively for H0, H1, H2 and therefore $R_f$=2.25.

We can thus see that by simply fixing a suitable threshold for $R_f$, for example $R_{fthreshold}$=1.6, the Rf passage over this threshold can activate an alarm indicating a defect.

A better appreciation of the seriousness of the defects can be obtained by simultaneously taking into account the three above mentioned criteria.

For this, a decision table, such as the one shown on FIG. 2, could be used to directly indicate to the operator the defectological status of the casting, that is, gives him an indication on the presence, the importance, and the development of defects and indicates the need to undertake corrective actions, such as the modification of certain casting parameters to attempt to correct the defects which have appeared, or at the very worst, the need to stop the casting to avoid irreparable damage to the casting installation.

This table presents, for instance, the procedure to be followed according to the relevant values of coefficients A, $R_f$ and E:

A "small" is the sign of low roller separating force variations, the casting being executed under good conditions, when A is "medium", and if R and E are "small", this means little or no defects, the casting is still being executed under good conditions, if R is "small" and E "large", this can mean that, although no real defects are present, the operating point of the installation is unstable, for reasons essentially related to the "normal" out-of-round, and a casting process alarm is triggered to inform the operator of the need to modify, for instance, the thermal conditions of the sleeve (temperature or flow rate of the cooling water), if R is "large" and E "small", which indicates the presence of defects, without a notable trend to their possible aggravation, a casting process alarm is set off, if R and E are "large", indicating the presence of defects and aggravation of these, shutdown of the casting process is requested, when A is "large", and if R and E are "small", no latent defect is signalled, normal out-of-round is correctly compensated for, but the amplitude of the displacements of the mobile roll to achieve this compensation is high, which is not serious for the casting itself, but may reveal problems in the geometry of the rolls, if R is "large" and E "small", which means also the presence of defects, but without notable aggravation, a casting process alarm is set off, if E is "large", irrespective of the value of R, significant aggravation of the defects is signalled and rapid shutdown of the casting process is requested.

Note that the "small", "medium" and "large" characters of the various criteria are assessed by comparison with experimental data acquired during earlier castings.

To illustrate the defect detection possibilities of the process according to the invention, refer to FIGS. 3*a*, 3*b*, 3*c* and 3*d*, which show variations to the various parameters measured and calculated during a casting with the out-of-round compensation process judged as good, and to FIGS. 4*a*, 4*b*, 4*c* and 4*d* which show a comparison of the curves obtained during a casting with shiny strip defects.

Figure 3A:
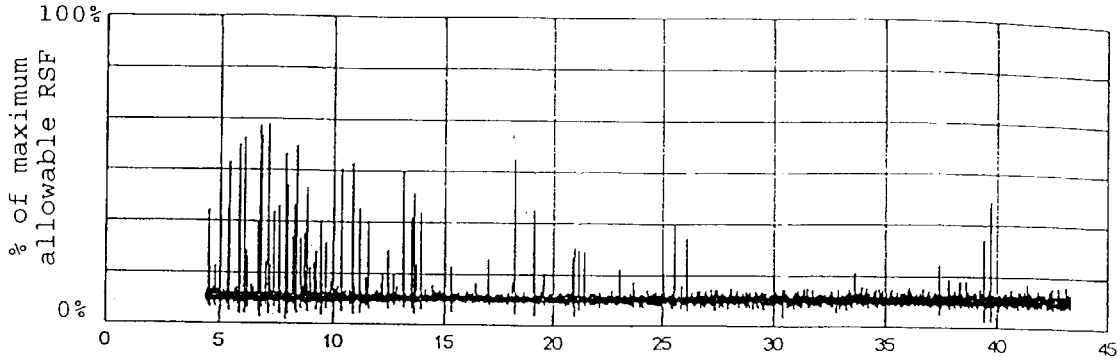
FIGS. 3*a*, 3*b*, 3*c* and 3*d* show, in the form of plots representing the variations of the various measured or calculated parameters, the results obtained from a casting judged as good with the out-of-round compensation process.
Figure 4A:
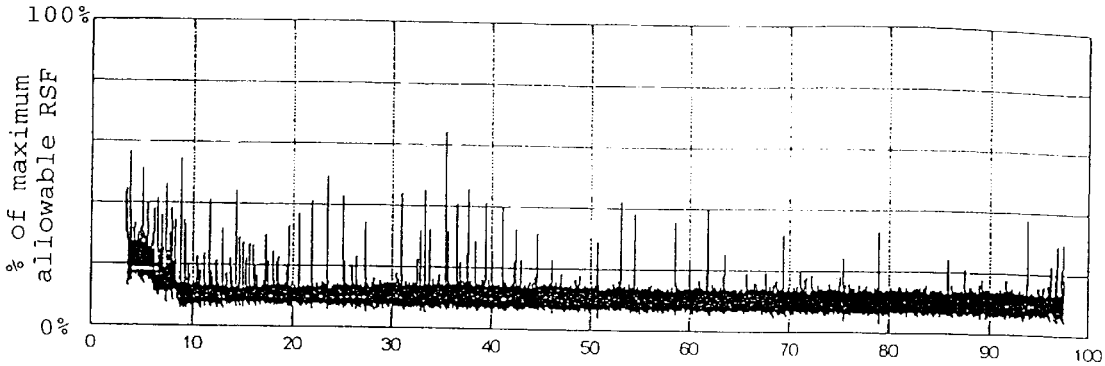
FIGS. 4*a*, 4*b*, 4*c* and 4*d* show the corresponding plots obtained during a casting judged as poor.

FIGS. 3*a* and 4*a* show the variations in the rolls separating force expressed in percentage of the permissible RSF measured for 40 minutes from start of casting.

Figure 3B:
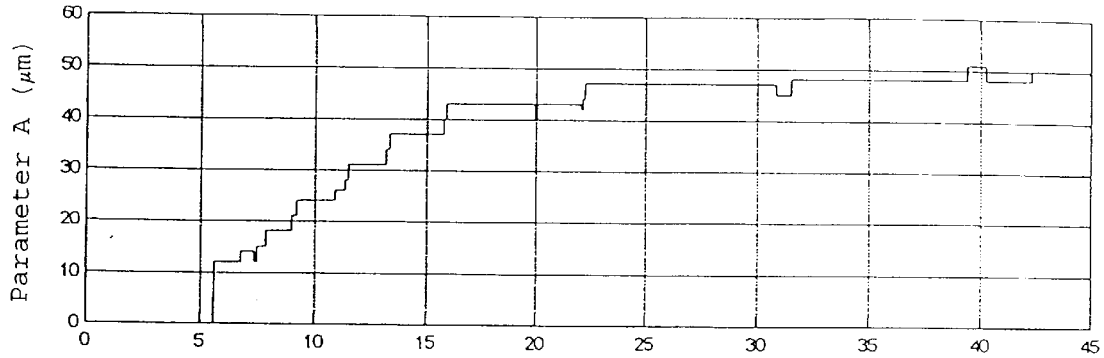
Figure 4B:
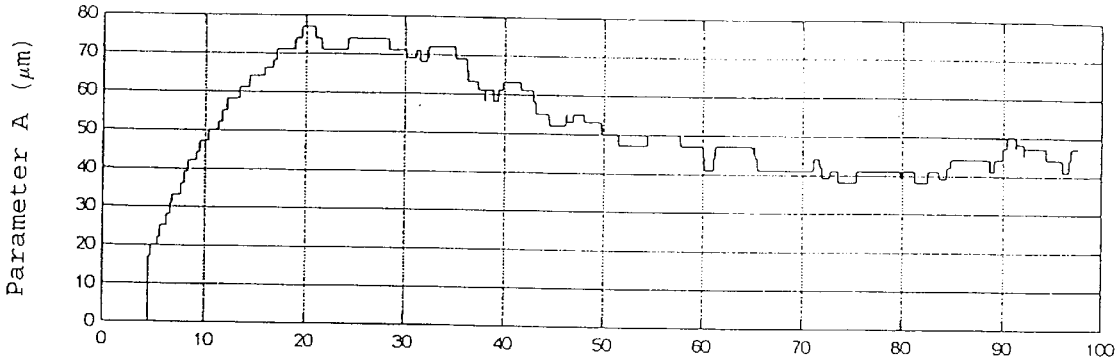

FIGS. 3*b* and 4*b* show change during this time of parameter A, that is the mean amplitude over 10 revolutions, in μm, of the displacement of the bearings of the mobile roll controlled by the out-of-round compensation module.

Figure 3C:
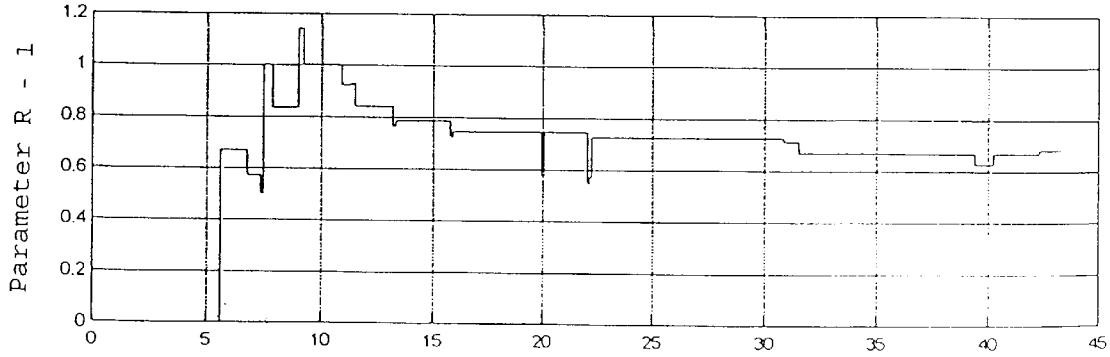
Figure 4C:
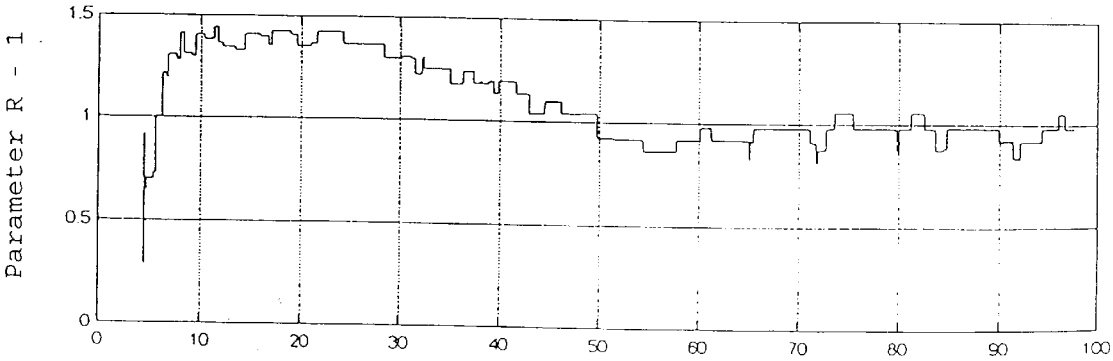

FIGS. 3*c* and 4*c* show changes in parameter R over time.

Figure 3D:
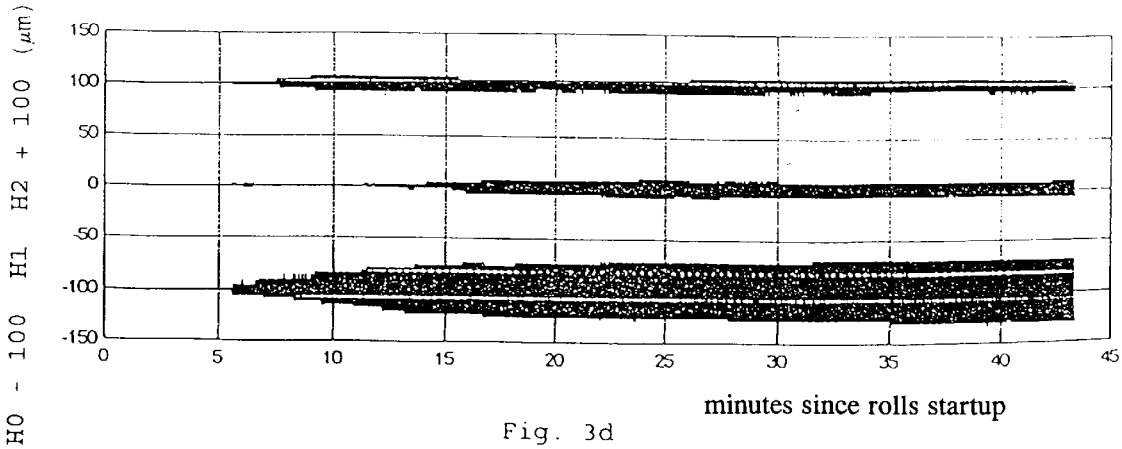
Figure 4D:
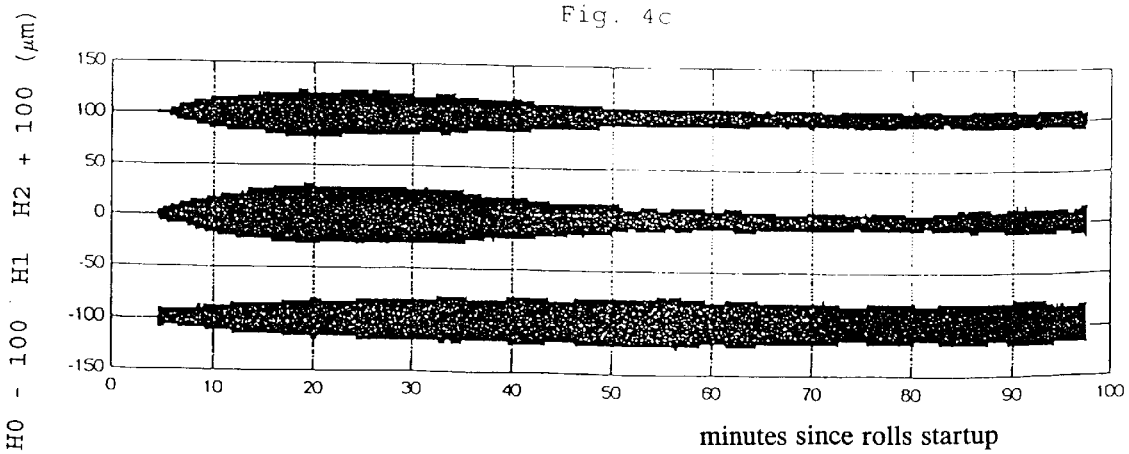

FIGS. 3*d* and 4*d* show on the same graph the changes over time of values $H_0$, $H_1$, and $H_2$, representative of the amplitudes of harmonics of orders 0, 1 and 2, the first one ($H_0$) being shown on the bottom of the diagram, the second ($H_1$) in the centre and the third ($H_2$) at the top.

We can see that, for a casting judged as good, the increase of A during around the first 20 minutes corresponds to a similar increase in $H_0$ and mainly reflects the evolution of the out-of-round compensation until stability of A is obtained at around 50 μm, indicating an almost perfect out-of-round compensation. Also note stability of parameter R after around 10 minutes, after excursion of R towards higher values, corresponding to a relatively high amplitude of $H_2$ during the same period at start of casting.

By comparison, the plots of FIGS. 4*b*, 4*c* and 4*d*, relevant to a casting whose execution was highly disturbed, show high amplitudes for $H_1$ and $H_2$ during around 40 minutes, with a high value of A during the same period and especially a high value of R.

It is easy to understand from these records that a comparison, made in real time during the casting process, of values A and especially R with predetermined thresholds, would have allowed to rapidly detect the defects corresponding to the high amplitudes of harmonics $H_1$ and $H_2$ and immediate action on the casting parameters to prevent their aggravation.

The invention is not restricted to the calculation methods of the various parameters given above only as an example.

In particular, by still using the same values $H_1$ representative of the amplitude of each harmonic, another barycentre B of the harmonic spectrum of the value representative of the rolls separating force could be calculated, for example, by then assigning to each value $H_i$ a carefully chosen weighting coefficient to accentuate in the calculated value of this barycentre the influence of the harmonics with the highest orders, which are those revealing defects. Irrespective of the type of barycentre calculation used, values representative of the various harmonics and the weighting coefficients relevant to each harmonic will be used so that it will be easy to follow the evolution of the value of the barycentre and compare it with experimental values in view of determining in real time a defectological level by comparison with the defectological condition (troublefree casting, disturbed casting, poor casting which led to a shutdown or damage to the rolls, etc.) of previous castings.

To compare the harmonics, it is also possible to define a reference distribution of the amplitudes of the harmonics as a percentage of each harmonic in relation to the total signal, for example by assuming a priori that the first harmonic represents 66% of this signal, the second 17% and the third also 17%. It would then be possible to follow the evolution of this distribution during each casting and, by comparing with the reference distribution, easily assess any deviations. This comparison could for instance be done by calculating a sum $R_d$ of the differences between the proportion $H_i/A$ of each harmonic component in the measured signal representative of the separating force and the reference proportion $\alpha_i$: $R_d=\text{pos}(\alpha_0-H_0/A)+\text{pos}(H_1/A-\alpha_1)+\ldots+\text{pos}(H_i/A-\alpha_i)$, (that is, each item of this sum is only counted if it is positive). In this way, if the proportion of the harmonic of order 0 is greater than the reference proportion or if the proportion of a harmonic of an order greater than or equal to 1 is lower than the reference proportion, the difference relevant to the considered harmonic is not taken into account. For instance, if the first harmonic represents for example 98% of A, the second 2% and the third 0%, which would correspond to almost total absence of harmonics of an order greater than 0 and therefore an absence of defects, $R_d=0$.

If the continuous casting installation between rolls does not include a gap regulation system as a function of the out-of-round, the process according to the previously described invention could of course be used by directly taking as signal subject to an harmonics decomposition the direct measurement of the rolls separating force (RSF) variations, the use of values $H_i$ obtained from the out-of-round compensation module remaining however especially practical when such a compensation module already exists on the installation and already performs, within the scope of its usual operation, the required decomposition into harmonics.

We claim:

1. A continuous casting process to obtain thin metallic products, the process comprising the steps of:

A. providing spaced apart casting rolls each mounted on bearings;

B. continuously measuring during casting a rolls separating force (RSF);

C. measuring a signal representative of the variations in the rolls separating force (RSF) as a function of time;

D. modifying the separation of the rolls as a function of the signal to compensate for the eccentricity of the rolls;

E. decomposing the signal into various harmonic components;

F. comparing the harmonic components with reference harmonics of corresponding order, the results of the comparison being representative of a defective status of the casting process; and G. defining rules for controlling the casting process according to the results of the comparison.

2. Process in accordance with claim 1, wherein the representative signal is obtained by measuring the variations of the rolls separating force (RSF) and is an associated signal used as a displacement reference for the bearings of one of the casting rolls in a separating regulation loop between the casting rolls.

3. Process in accordance with claim 1, wherein a Fourier transform is used to decompose the signal representative of the rolls separating force (RSF) into various harmonic components.

4. Process in accordance with claim 1, wherein to make the comparison, the value used as a value representative of each harmonic of order i is a value $H_i$ corresponding to a mean of amplitudes $h_i$ of the harmonics of this order measured over a given number of revolutions.

5. Process in accordance with claim 1, wherein to make the comparison, a barycentre of the harmonics is used, the barycentre being calculated by weighting a value representative of each harmonic with a predetermined coefficient.

6. Process in accordance with claim 5, wherein a frequency barycentre $B_f$ is calculated using a formula: $B_f=\Sigma(H_i\times F_i)/\Sigma H_i$, where the value $F_i$ is a frequency representative of each harmonic and the weighting coefficient $H_i$ represents an amplitude of the considered harmonic.

7. Process in accordance with claim 6, wherein the comparison is made on the basis of a ratio $R_f$ calculated by using the formula: $R_f=B_f/F_0$, where $F_0$ is a frequency corresponding to the rotational speed of the rolls.

8. Process in accordance with claim 1, wherein the comparison is made by using as comparison criterion the formula as a proportion: $H_i/A$ of each harmonic component in relation to the signal representative of the rolls separating force, wherein $H_i$ represents the amplitude of the harmonic of order i and A represents $\Sigma H_i$.

9. Process in accordance with claim 8, wherein the result of the comparison is represented by the sum $R_d=\text{pos}(\alpha_0-H_0/A)+\text{pos}(H_1/A-\alpha_1)+\ldots+\text{pos}(H_i/A-\alpha_i)$;

wherein $\alpha$ is a reference harmonic proportion for each harmonic order component representing that particular harmonic order component's percentage of the total variation signal;

a harmonic proportion defect status value for a zero order harmonic order component is represented by the formula $\alpha_0-(H_0/\Sigma H_i)$ and a negative result is equated to zero;

a harmonic proportion defect status value for a first order harmonic order component is represented by the formula $(H_1/\Sigma H_i)-\alpha_1$ and equating a negative result to zero; and a harmonic proportion defect status value for each remaining harmonic order i is represented by the formula $(H_i/\Sigma H_i)-\alpha_i$ and a negative result is equated to zero.

10. Process in accordance with claim 7, wherein a decision table is used to determine the procedure to be followed for the casting according to values of criteria:

$\Sigma H_i$, $R_f$, and $E=dR/dt$ wherein E represents monitoring a variation of $R_f$ over time wherein such variation is represented by E.

11. A process in accordance with claim 9, wherein a decision table is used to determine the procedure to be followed for the casting according to values of criteria: $\Sigma H_i$, $R_d$, and $E=dR/dt$ wherein E represents monitoring a variation of $R_d$ over time wherein such variation is represented by E.

12. A process for continuously casting thin metallic products, the process comprising the steps of:

mounting casting rolls on bearings and adjacent one another to define a separation between the casting rolls;

casting a metallic material between the casting rolls;

continuously measuring during the casting step a separating force between the casting rolls;

measuring a variation signal representing variations in the separating force as a function of time;

altering the separation between the casting rolls as a function of the variation signal to compensate for eccentricity in each of the casting rolls;

decomposing the variation signal into harmonic order components;

comparing the harmonic order components to reference harmonics of corresponding harmonic order to acquire a defective status in the casting process; and defining rules for controlling the casting process according to results of the comparing step.

13. The process according to claim 12, wherein the steps of measuring and altering further comprise:

measuring the variation signal as a loop signal generated in a separation regulating loop wherein the loop signal is a function of the variations in the separating force; and altering the separation by displacing at least one of the casting rolls at the bearings using the loop signal as a displacement reference.

14. The process according to claim 12 wherein the step of decomposing further comprises:

using a Fourier transform to decompose the variation signal.

15. The process according to claim 12 wherein the step of comparing further comprises:

determining a number of harmonic amplitudes represented by $h_i$ at each of a plurality of harmonic orders represented by i over a number of revolutions of the casting rolls; and calculating for each harmonic order i a mean amplitude value represented by $H_i$ corresponding to the mean of the harmonic amplitudes $h_i$.

16. The process according to claim 12 wherein the step of comparing further comprises:

determining a harmonic barycentre by weighting each of the harmonic order components with a predetermined coefficient.

17. The process according to claim 12 wherein the step of comparing further comprises:

determining a number of harmonic amplitudes represented by $h_i$ at each of a plurality of harmonic orders represented by i over a number of revolutions of the casting rolls;

calculating for each harmonic order i a mean amplitude value represented by $H_i$ corresponding to the mean of the harmonic amplitudes $h_i$;

defining a frequency value represented by $F_i$ wherein $F_i$ represents a frequency of each harmonic order;

calculating a sum of the mean harmonic values $H_i$; and calculating a frequency barycentre represented by $B_f$ using a formula:

$$B_f=(\Sigma(H_i \times F_i))/\Sigma H_i.$$

18. The process according to claim 17 wherein the step of comparing further comprises:

determining a frequency represented by $F_0$ corresponding to a rotational speed of the casting rolls; and calculating a ratio represented by $R_f$ using a formula:

$$R_f=(B_f/F_0).$$

19. The process according to claim 12 wherein the step of comparing further comprises:

determining a number of harmonic amplitudes represented by $h_i$ at each of a plurality of harmonic orders represented by i over a number of revolutions of the casting rolls;

calculating for each harmonic order i a mean amplitude value represented by $H_i$ corresponding to the mean of the harmonic amplitudes $h_i$; and calculating a harmonic proportion represented by $H_i/\Sigma H_i$ for each harmonic order i by dividing each mean amplitude value $H_i$ by the sum of the mean amplitude values represented by $\Sigma H_i$.

20. The process according to claim 19 wherein the result of the step of comparing comprises:

determining a reference harmonic proportion $\alpha_i$ for each harmonic order component representing that particular harmonic order component's percentage of the total variation signal;

calculating a harmonic proportion defect status value for a zero order harmonic order component using a formula $\alpha_0-(H_0/\Sigma H_i)$ and equating a negative result to zero;

calculating a harmonic proportion defect status value for a first order harmonic order component using a formula $(H_1/\Sigma H_i)-\alpha_1$ and equating a negative result to zero;

calculating a harmonic order defect status value for each remaining harmonic order i using a formula $(H_i/\Sigma H_i)-\alpha_i$ and equating a negative result to zero; and calculating a sum of the harmonic proportion defective status values represented by $R_d$.

21. The process according to claim 18 wherein the step of controlling further comprises:

monitoring a variation of $R_f$ over time wherein such variation is represented by E; and controlling the casting process according to the values of E, $R_f$, and $\Sigma H_i$.

22. The process according to claim 21 wherein the step of controlling further comprises:

monitoring a variation of $R_d$ over time wherein such variation is represented by E; and controlling the casting process according to the values of each of E, $R_d$, and $\Sigma H_i$.

* * * * *